US011806850B2

(12) United States Patent
Wolf

(10) Patent No.: US 11,806,850 B2
(45) **Date of Patent: *Nov. 7, 2023**

(54) CLAMP WITH NESTED REVERSIBLE INTERLOCKING ASSEMBLIES

(71) Applicant: Barton Steven Wolf, Brookfield, WI (US)

(72) Inventor: Barton Steven Wolf, Brookfield, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/071,990

(22) Filed: Nov. 30, 2022

(65) Prior Publication Data

US 2023/0086341 A1 Mar. 23, 2023

Related U.S. Application Data

(62) Division of application No. 17/155,588, filed on Jan. 22, 2021, now Pat. No. 11,541,511.

(51) Int. Cl.
*B25B 5/06* (2006.01)
*B25B 5/02* (2006.01)

(52) U.S. Cl.
CPC ..... *B25B 5/067* (2013.01); *B25B 5/02* (2013.01)

(58) Field of Classification Search
CPC ..... B25B 5/02; B25B 5/067; B25B 5/068; B25B 5/16; B25B 5/166; B25B 5/102; B25B 5/103; B25B 5/125
USPC ..... 269/86, 147, 167, 168, 169, 170, 172
See application file for complete search history.

(56) References Cited

U.S. PATENT DOCUMENTS 6,971,641 B1 * 12/2005 Sherwin ..... B25B 5/10 269/166
7,114,715 B1 * 10/2006 Kirk ..... B25B 5/166 269/6
2017/0232580 A1 * 8/2017 Howard ..... B25B 1/103 269/81

* cited by examiner

*Primary Examiner* — Brian D Keller
*Assistant Examiner* — Alberto Saenz

(57) ABSTRACT

The present invention relates to a work holding and clamping device, which increases the usable span to almost twice its stored length. This clamping device has an inner and outer assembly which are nested, and each assembly is made of a rectangular tube with a jaw affixed to one end. The inner assembly contains a locking mechanism to allow for length adjustment. When arranged so that the jaws are on the same side of the respective assemblies, the clamp is capable of a span that is almost equal to the length of the inner assembly. When arranged so that the jaws are on opposite sides of the respective assemblies, the clamp is capable of a span that is almost equal to the sum of the length of the inner assembly and outer assembly.

7 Claims, 12 Drawing Sheets

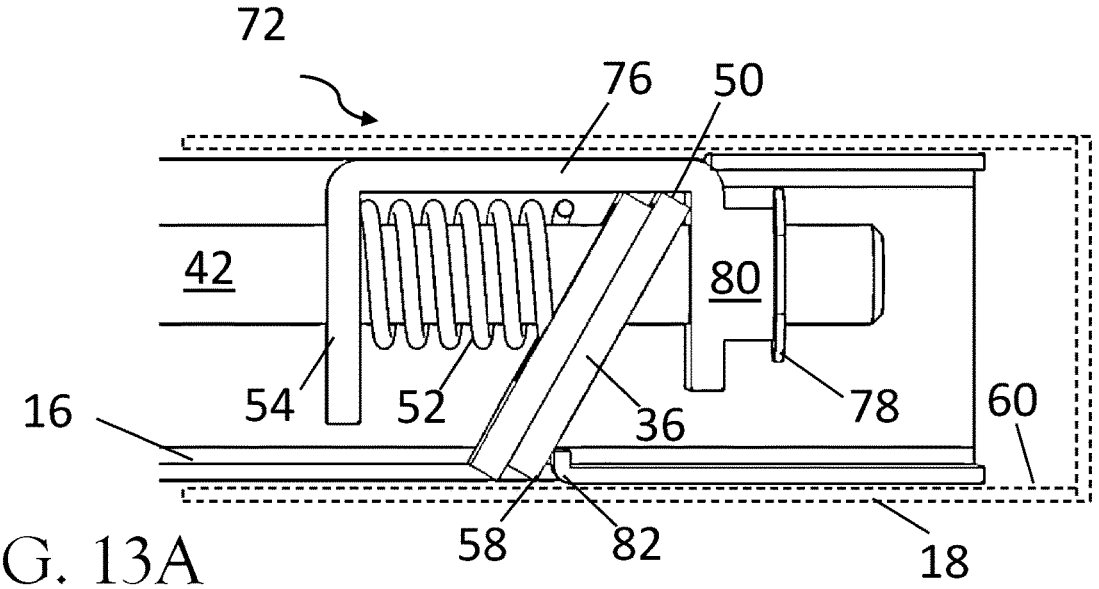
FIG. 13A
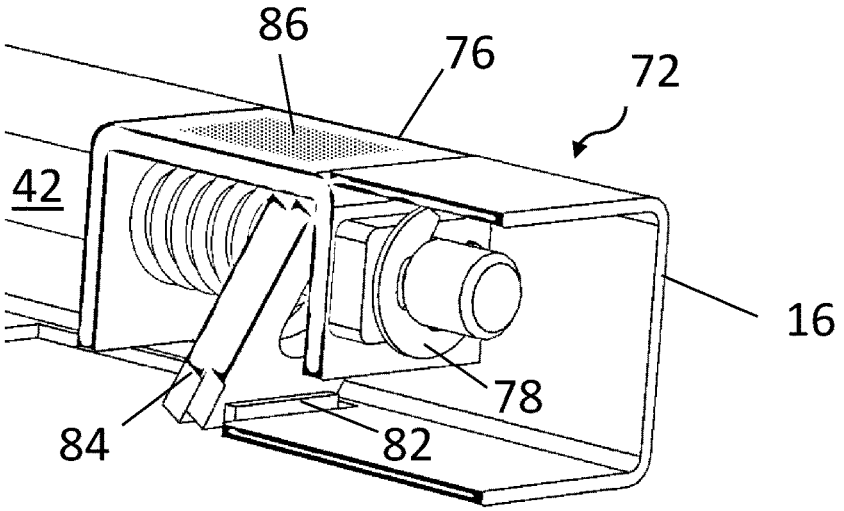
FIG. 13B
FIG. 13C
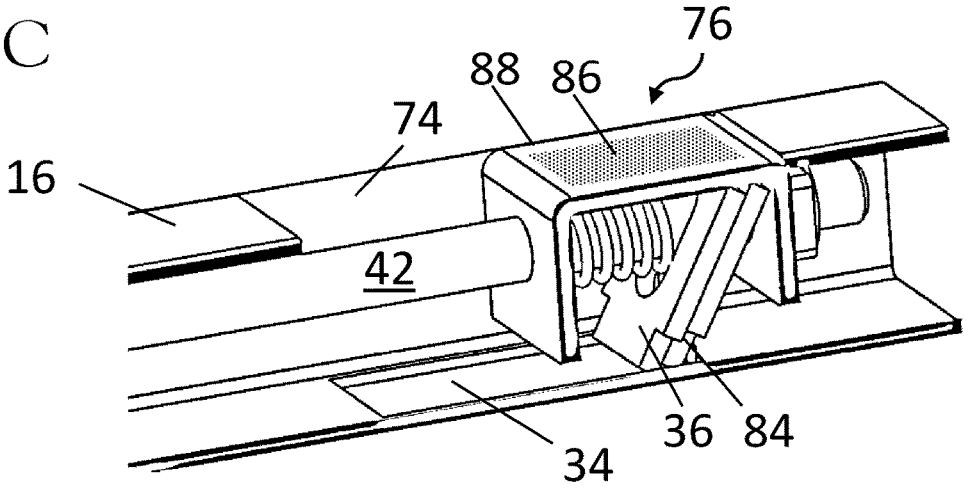

CLAMP WITH NESTED REVERSIBLE INTERLOCKING ASSEMBLIES

CROSS-REFERENCE TO RELATED APPLICATION

This application claims the benefit of U.S. Provisional Application No. 62/965,828 filed Jan. 25, 2020, U.S. Provisional Application No. 62/965,827 filed Jan. 25, 2020, and U.S. Provisional Application No. 63/028,559 filed May 22, 2020.

FIELD OF THE INVENTION

The present invention generally relates to clamping tools. More specifically, it relates to a mechanical clamping system having nested reversible interlocking assemblies enabling multiple configurations, the ability to quickly adjust the span between jaws, and to create a span between jaws that exceeds the minimum overall length obtainable by the device.

BACKGROUND

Currently there are a number of clamping or work holding devices that can be adjusted for use on a variety of work piece sizes. A common shortcoming across the existing clamping designs is that their maximum usable length is less than the overall length of the device. In addition, most bar style clamps are limited to a single clamping configuration having directly opposing jaws. In summary, they simply lack the utility to meet the needs of the industry and thereby requiring craftsmen to obtain multiple clamps of assorted sizes and arrangements to carry out a wide variety of tasks. This can result in a requirement for excessive storage space, using clamping devices much longer than required for smaller work pieces leading to tipping or loss of maneuverability around the work piece, and excessive capital costs.

SUMMARY OF THE INVENTION

A general requirement for a clamping device is that the device can adjust to hold or provide clamping force for a range of lengths to account for different size work pieces. It is desirable to have a device that can be adjusted quickly allowing the user to start with the device adjusted to a length much longer than the work piece and then quickly reduce the distance between jaws to the size of the work piece. Still further, it would be desirable to have a device that can be made compact for storage. A typical bar clamp has a fixed jaw secured to a bar on which a moveable jaw assembly traverses for the purposes of securing a workpiece between the fixed and moveable jaw. While this design meets some of the requirements, the span that can be used for clamping materials is limited by the length of the bar.

Disclosed are clamping devices comprising a two-piece nested bar assembly. The first assembly includes an inner bar, locking mechanism, a fixed jaw, and means for applying clamping forces. The second assembly includes an outer bar capable receiving the inner bar of the first assembly and a movable jaw secured to the outer bar. Additionally, the outer bar is hollow and open ended such that the inner bar may be received from either end of the outer bar—thereby making the second assembly reversable relative to the first assembly. The disclosed device advantageously meets all requirements and addresses the aforementioned deficiencies by providing the ability to quickly adjust the span between jaws and create a span between jaws that exceeds the minimum overall length obtainable by the device.

This disclosure will now provide a more detailed and specific description that will refer to the accompanying drawings. The drawings and specific descriptions of the drawings, as well as any specific or alternative embodiments discussed, are intended to be read in conjunction with the entirety of this disclosure. The clamp with nested reversible interlocking assemblies and means for applying clamping force. may, however, be embodied in many different forms and should not be construed as being limited to the embodiments set forth herein; rather, these embodiments are provided by way of illustration only and so that this disclosure will be thorough, complete and fully convey understanding to those skilled in the art.

BRIEF DESCRIPTION OF THE FIGURES

The accompanying drawings, which are incorporated herein and form a part of the specification, illustrate some, but not the only or exclusive, examples of embodiments and/or features.

FIGS. 13A, 13B, and 13C are cut-away views of the clutch mechanism of the parallel jaw clamping device.

Figure 1:
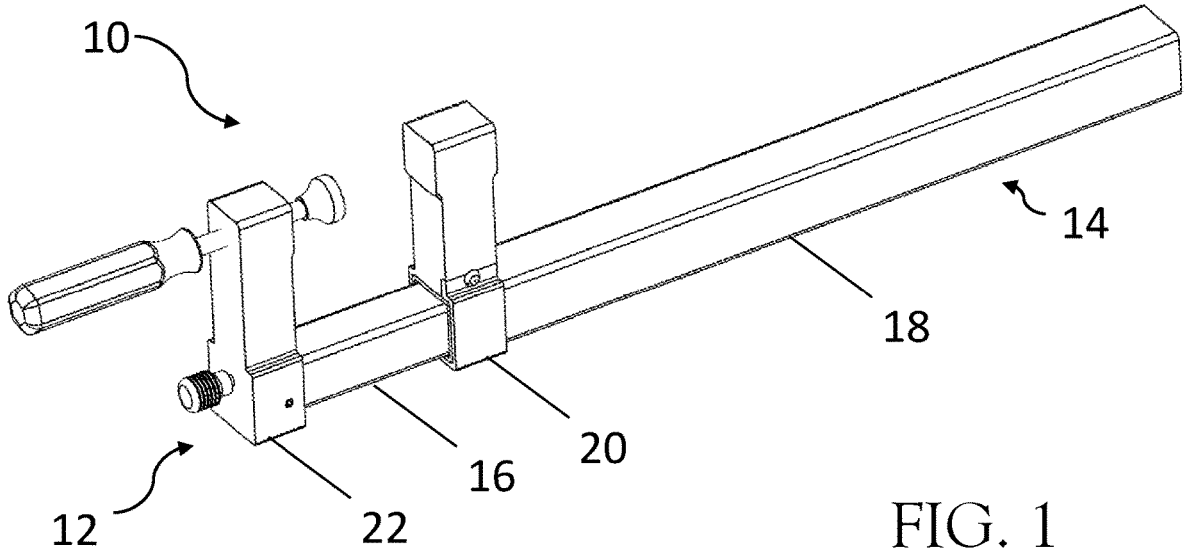
FIG. 1 shows an upper isometric view of a F-style clamping device with a nested bar assembly.

Other aspects of the present invention shall be more readily understood when considered in conjunction with the accompanying drawings, and the following detailed description, neither of which should be considered limiting.

DETAILED DESCRIPTION OF THE INVENTION

The present invention is directed to a clamping device with nested reversible interlocking assemblies and external means for applying clamping force. The disclosed device is unique when compared with other known devices and solutions. First, the mechanical structure of the clamping device includes separate inner and outer assemblies that can be reconfigured, an internal locking mechanism, and a separate user interface for producing clamping force. The mechanics provide additional utility that enable a stored length that is less than the maximum usable length, a length during use that is less than its maximum extended length unless required by the work piece, enables a plurality of clamping angles, and ease of adjustment and configuration.

The associated method of use is unique in that it enables the user to reorient the outer assembly of the device relative to the inner assembly depending on the size of the workpiece, reconfigure the inner and outer assemblies to engage a plurality of clamping angles, and allows the user to shorten the device before storing the device requiring less storage space. Similarly, the disclosed method is unique when compared with other known processes and solutions in that it uses a standalone internal locking mechanism enabling the user to engage the mechanism for locking and unlocking mechanism. The inventive concept presented herein is demonstrated across two styles of clamps, specifically a F-style clamp and a parallel jaw clamp with minor modifications to accommodate minor differences. It will be apparent to the user that the concept may be applied to a variety of clamp styles and in some cases that the minor differences may be used interchangeably.

In this description, the drawings are used for convenience only; they are not intended to be limiting or to imply that the device has to be used or positioned in any particular orientation. Conventional components of the invention are elements that are well-known in the prior art and will not be discussed in detail for this disclosure.

It is additionally noted and anticipated that although the device is shown in its simplest form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention and are not to be considered limiting in any manner. While all the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth.

It is briefly noted that upon a reading this disclosure, those skilled in the art will recognize various means for carrying out these intended features of the invention. As such it is to be understood that other methods, applications and systems adapted to the task may be configured to carry out these features and are therefore considered to be within the scope and intent of the present invention and are anticipated. The invention herein described is capable of other embodiments and of being practiced and carried out in various ways which will be obvious to those skilled in the art. Also, it is to be understood that the phraseology and terminology employed herein are for the purpose of description and should not be regarded as limiting.

Referring now to FIG. 1, in its most complete form, the clamp 10 (shown as an F-style clamp) is comprised of an inner assembly 12 and outer assembly 14. The inner assembly has a fixed jaw 22 located and affixed to a proximal end of a length of a generally square or rectangular tube, herein the inner tube 16. The outer assembly has an adjustable jaw 20 affixed to an end of a second length of square or rectangular tube, herein the outer tube 18. The lateral cross-sectional dimensions of the inner tube 16 are such that the inner tube may be nested into and traverse through the outer tube 18 as shown.

In this figure the inner and outer assemblies are nested such that the adjustable jaw 20 on the outer assembly 14 is oriented such that it is adjacent to the fixed jaw 22 on the inner assembly 16. Since the outer assembly is able to travel along the length of the inner assembly the clamp can achieve a span between the jaws that range from essentially zero (i.e., contact between jaws) to a length nearly equal to the outer assembly. This allows the user to minimize the overall length of the device during storage. This also allows for use of the device on smaller work pieces.

Figure 2:
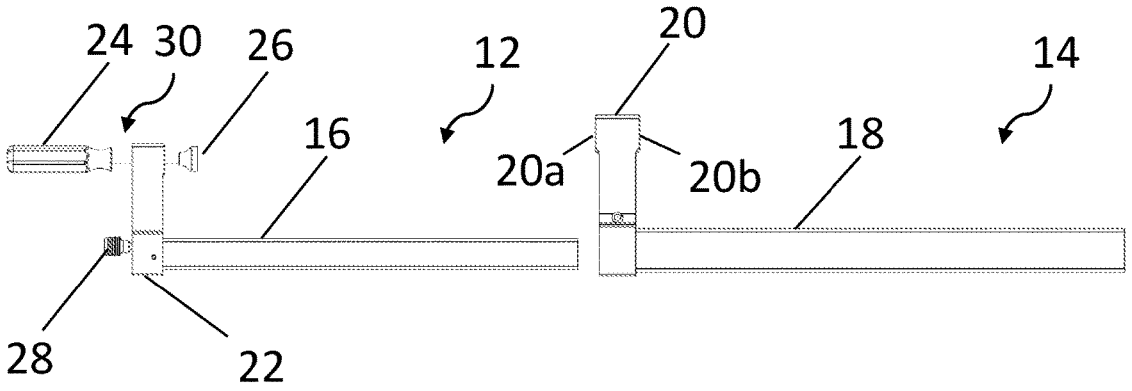
FIG. 2 shows a side view of a F-style clamping device with the nested bar assembly separated into discrete assemblies.

FIG. 2 shows the F-style clamp 10 divided into its separate assemblies, specifically the inner assembly 12 and outer assembly 14. The inner assembly 12 further comprises a screw clamp 30 integrated into the fixed jaw 22 of the inner assembly which includes a screw clamp handle 24 attached to a rod opposite a pressure pad 26 for applying force to a workpiece. Adjacent to the fixed jaw 22 is an unlocking handle 28. The unlocking handle 28 is affixed to a rod that extends internally along the length of the inner tube 16 and engages an internal locking mechanism which selectively secures the outer tube 18 in place.

Both the outer tube of the outer assembly and inner tube of the inner assembly share a longitudinal or medial axis extending the length of the tube and is hereby defined as the horizontal axis.

The inner tube 16 of the inner assembly 12 may be inserted into either end of the outer tube 18 of the outer assembly 14 in a telescopic manner allowing for variation of the invention's span. The square or rectangular tube of the inner assembly is sized relative to the square or rectangular tube of the outer assembly such that there is minimal clearance between tubes while allowing free motion along the common center axis of the inner assembly and outer assembly.

In some embodiments, as shown in FIG. 2, the profile of the adjustable jaw 20 which engages the workpiece (shown as 20*a*) and the corresponding and opposing profile of the adjustable jaw (shown as 20*b*) are mirror images of another. The significance of this feature will become apparent in view of the reversible nature of the outer assembly 14.

Figure 3A:
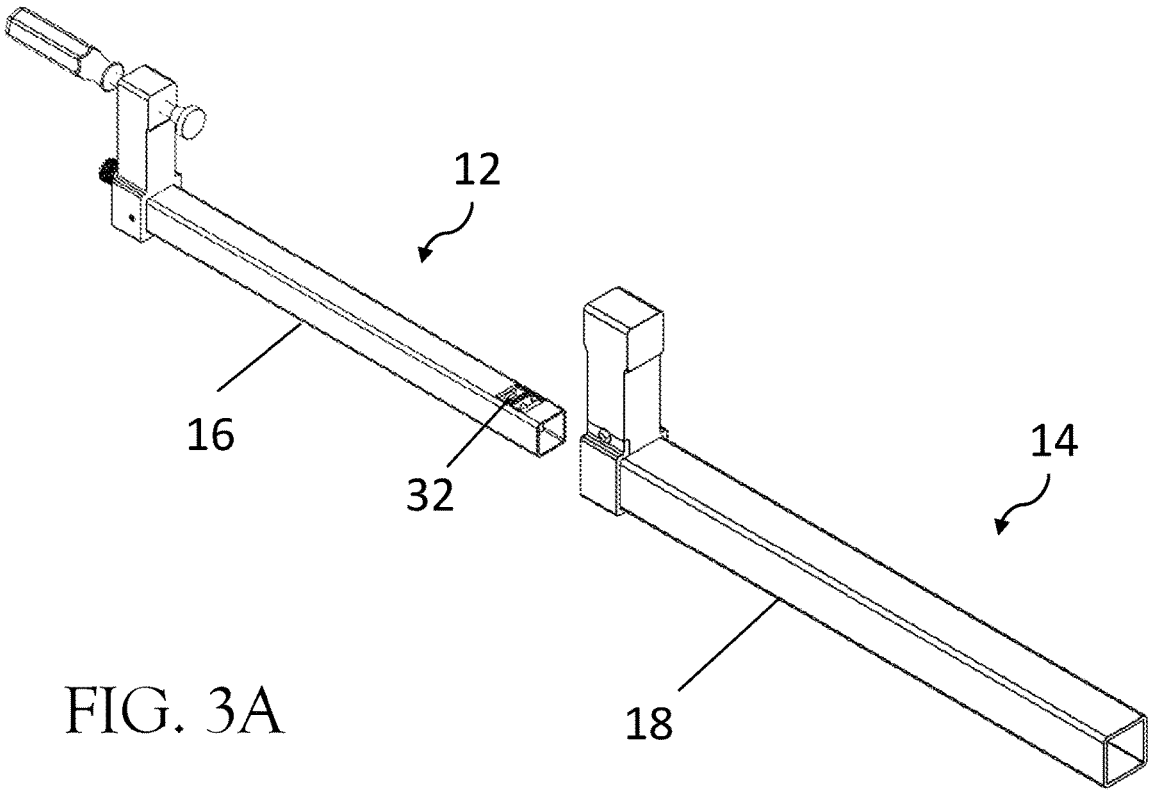
FIGS. 3A and 3B illustrates the F-style clamping device with nested bar assemblies.
Figure 3B:
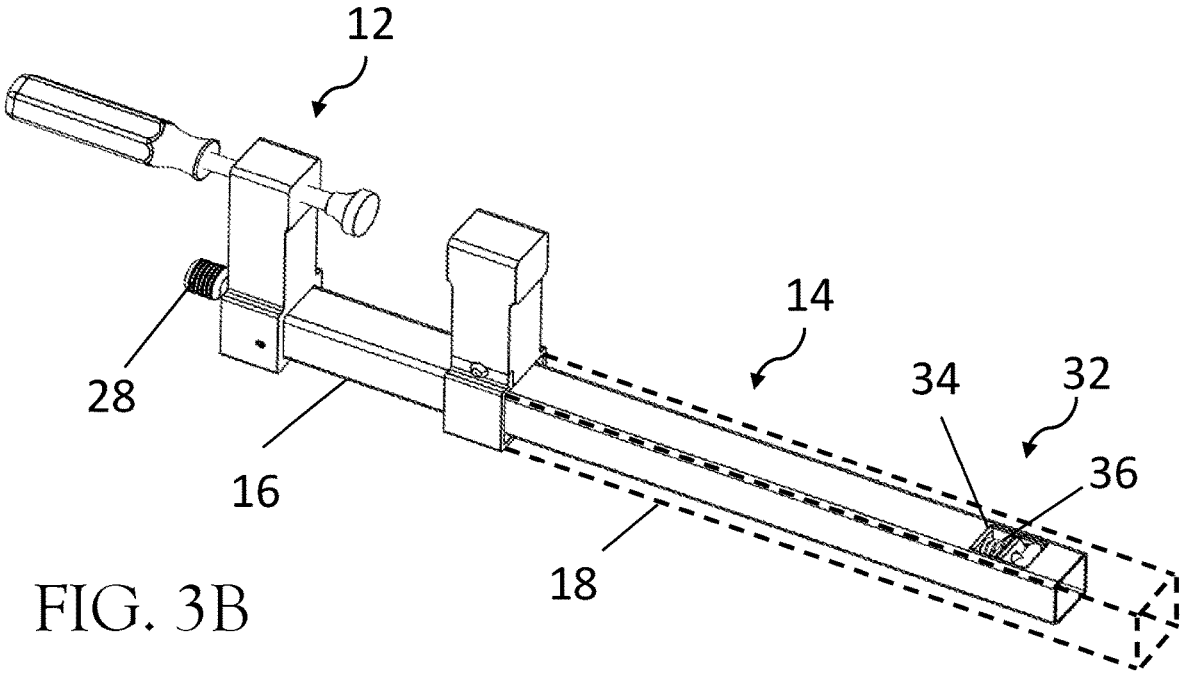

FIGS. 3A and 3B provide an upper isometric view of the F-style clamp 10 divided into separate assemblies and then combined allowing the internal locking mechanism 32 to be viewed. The details of the locking mechanism mechanics will be presented in later figures, however, FIG. 3B provides a general understanding of the concept. As shown, an aperture 34 exists in the upper surface of the inner tube 16 through which a series of locking plates 36 may protrude. The locking plates are configured such that they may come in communication with the inner surface of the outer tube 18 causing a one-way frictional lock—meaning that the outer tube may freely traverse in one direction across the inner bar 16 but be held in place in the opposite direction by pressure applied by the locking plates 36. The pressure may be set by use of the unlocking handle 28. In the preferred embodiment, the locking plates are configured such that the outer bar may freely traverse in the proximal direction (i.e., towards the fixed jaw) thus enabling the clamp to be adjusted quickly and allowing the user to start with the device adjusted to a length much longer than the work piece and then quickly reduce the distance between jaws to the size of the work piece.

Figure 4A:
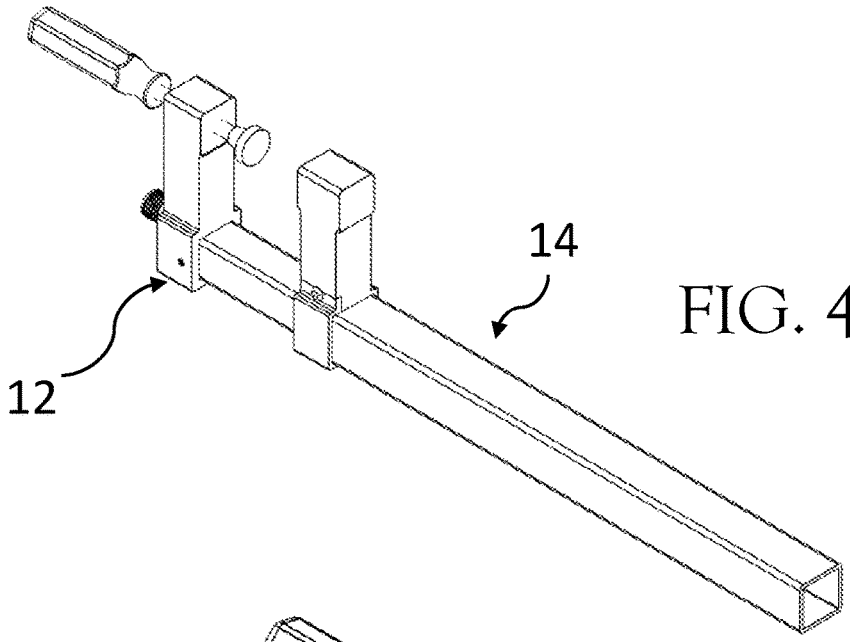
FIGS. 4A, 4B, and 4C illustrates the F-style clamping device in multiple configurations with the moveable bar rotated.
Figure 4B:
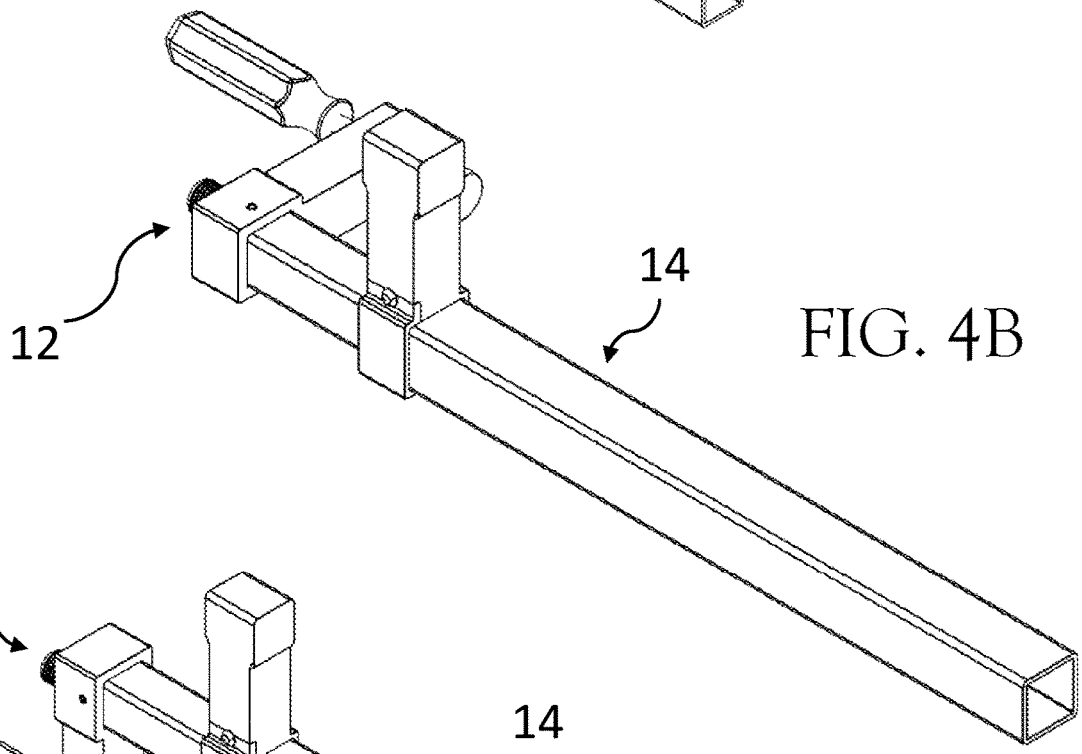
Figure 4C:
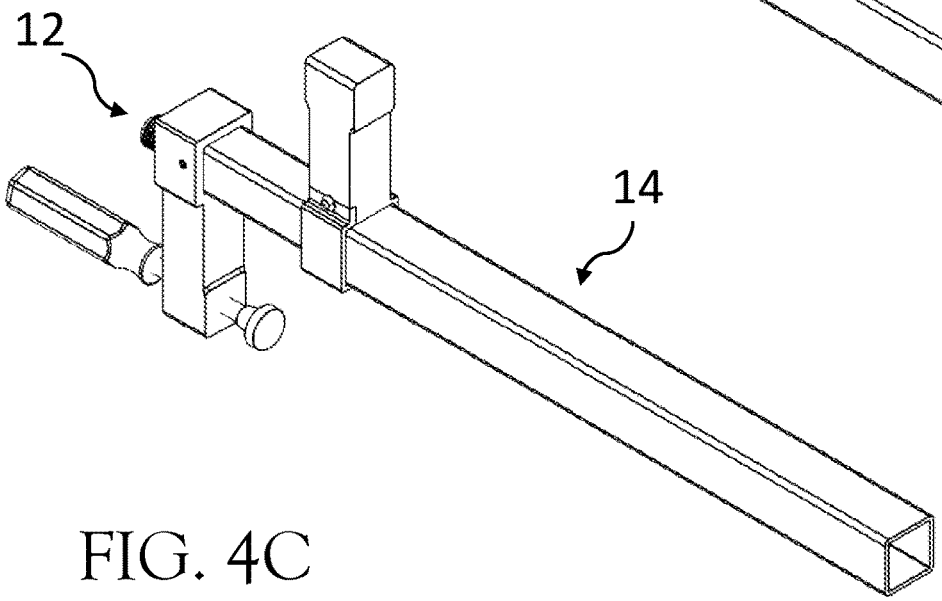

FIG. 4A-4C illustrate a benefit of the tubular nested assemblies where they enable the jaws to be positioned in a variety of configurations to accommodate the requirements of various workpieces, thereby increasing utility. Specifically, FIG. 4A illustrates the most common configuration whereby the fixed and adjustable jaws are directly opposing or whereby the inner assembly 12 is rotated 0 degrees relative to the axis of the outer tube of the outer assembly 14. FIG. 4B illustrates a configuration whereby the inner assembly is rotated 90 degrees relative to the outer assembly and additionally, it is understood that FIG. 4B may be rotated 90 degrees clockwise or counter clockwise creating a configuration that may be expressed as an inner assembly being rotated 90 or 270 degrees relative to the axis of the outer tube of the outer assembly. Finally, FIG. 4C illustrates a configuration whereby the inner assembly is rotated 180 degrees relative to the axis of the outer tube of the outer assembly.

Figure 5A:
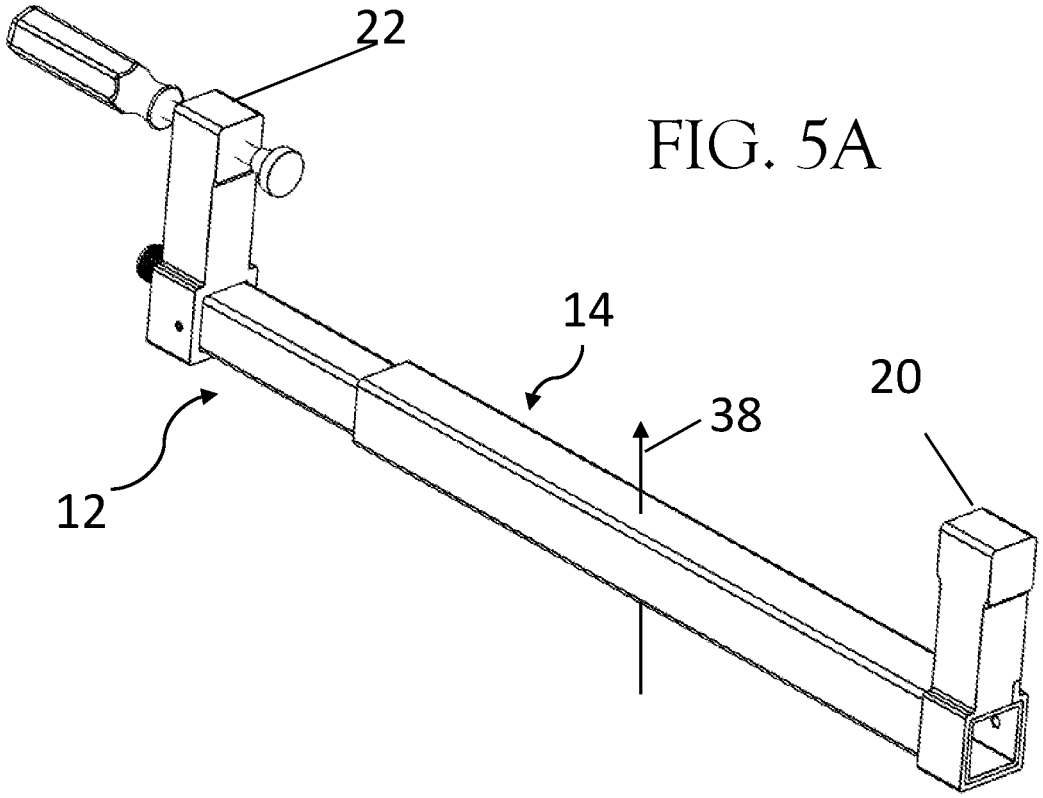
FIGS. 5A and 5B illustrate the F-style clamping device in multiple configurations with the movable bar reversed and rotated.
Figure 5B:
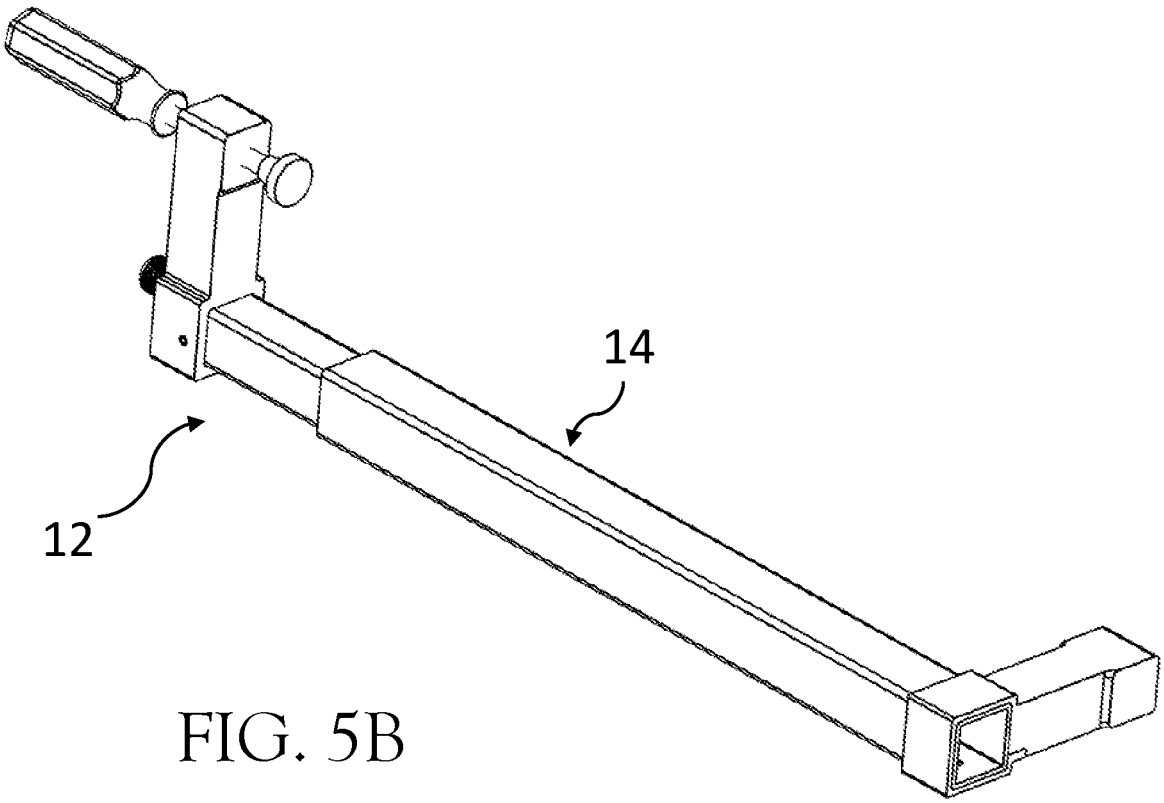

In the foregoing figures and text, the outer assembly has been oriented such that the adjustable jaw has been located at a proximal end of the outer assembly or towards the fixed jaw. FIG. 5A-5B, however, illustrate an additional benefit of the nested assemblies being reversable. As shown in FIG. 5A, the outer assembly 14 is now oriented onto the inner assembly 12 such that the adjustable jaw 20 is located at the opposite or distal end of the outer assembly. Stated otherwise, the outer assembly may be rotated 180 degrees around the vertical axis 38 prior to being conjoined with the inner assembly 12. As previously presented, FIG. 5B illustrates the configuration whereby the inner assembly is rotated relative to the horizontal axis of the outer tube of the outer assembly—and it understood that the rotation may be 0, 90 180, or 270 degrees.

Figure 6:
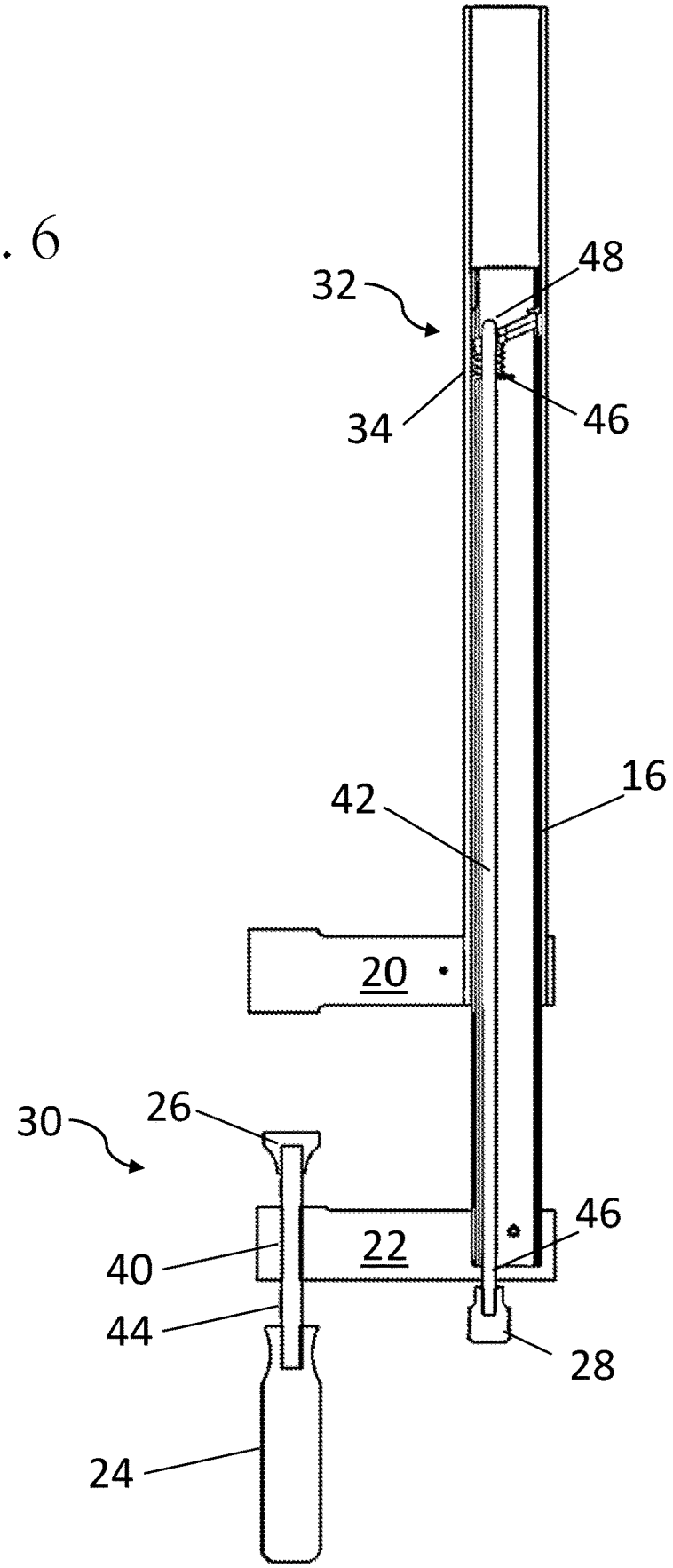
FIG. 6 shows a cut away side view of the F-style clamping device illustrating the clutch locking mechanisms.

FIG. 6 shows a side cut-away sectional view of the F-style clamp allowing visibility of the system which controls the locking mechanism 32 and screw clamp 30.

The screw clamp 30 is integrated into the fixed jaw 22 and comprises the screw clamp handle 24 attached to the screw clamp rod 44 coupled to the pressure pad 26 opposite the handle. The screw clamp rod passes through a screw clamp receiver 40. In the preferred embodiment, the screw clamp rod and receiver are threaded such that rotation of the handle along the axis of the screw clamp rod 44 causes the pressure pad 26 to traverse perpendicular the axis and thereby apply pressure to the workpiece.

The system which controls the locking mechanism comprises the unlocking handle 28 affixed at the proximal end of an actuation bar 42, and a lock release bar 48 located at the distal end of the actuation bar 42. The actuation bar is supported within the inner tube 16 by at least one actuation bar support 46 which allows the actuation bar to horizontally retract and extend the lock release bar. The actuation bar support 46 may be a passage or aperture at fixed position relative to the inner tube. The actuation bar support 46 constrains the relative movement to the actuation bar to its axis. In the preferred embodiment there are two actuation bar supports 46 with the first located near the proximal end of the actuation bar 42 and preferrable integrated into the fixed jaw 22, and a second located near the distal end of the actuation bar and preferably integrated into the locking mechanism 32. Pulling the unlocking handle 28 proximally causes the actuation rod 42 and subsequently the lock release bar 48 to release the locking mechanism 32.

Figure 7A:
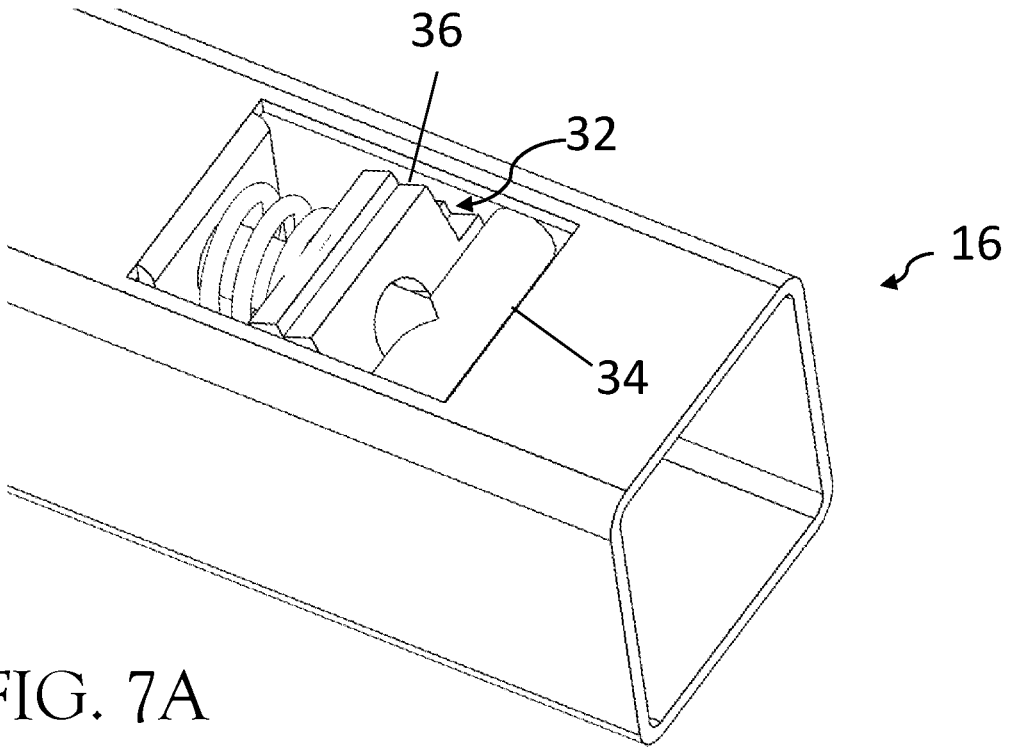
FIGS. 7A and 7B show an upper isometric view and a cut away view of a clutch locking mechanism for a clamping device.
Figure 7B:
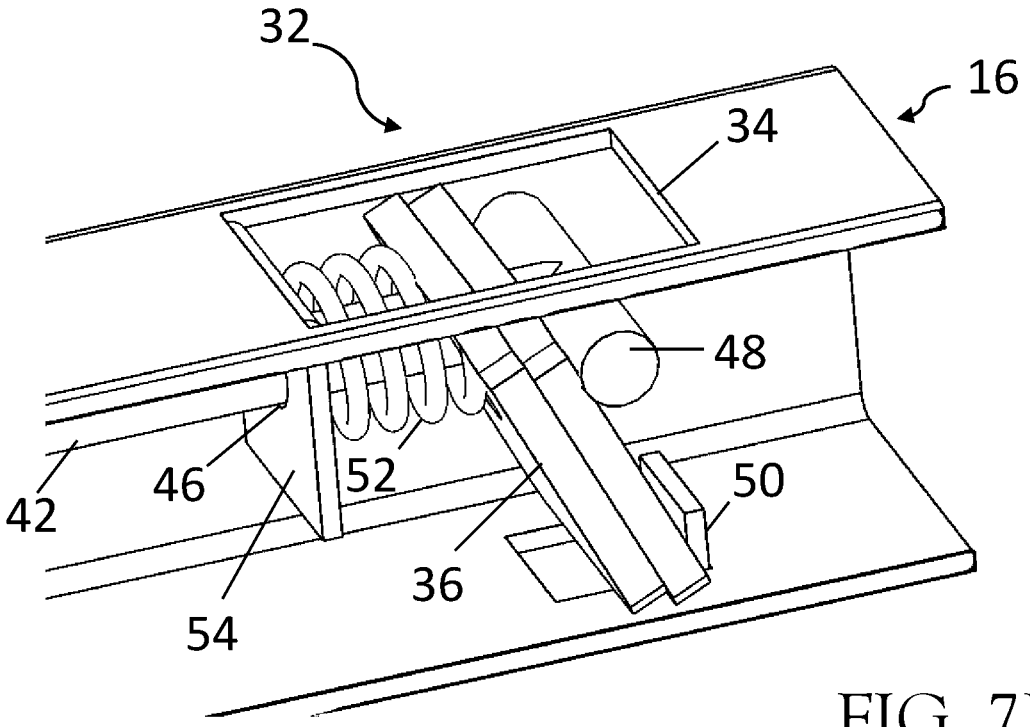

FIGS. 7A and 7B show details of the locking mechanism and specifically show a downward view of the locking mechanism 32 within the inner tube 16 and a side cut-away view of the locking mechanism within of the inner tube respectively. FIG. 7A shows the aperture 34 preferably as an opening in the top wall of the inner tube, however, the exact orientation of the locking mechanism presented may function equivalently in any orientation. A plurality of locking plates which will engage with the outer tube are shown, however, the inventive concept applies provided at least one locking plate is present.

FIG. 7B provides additional details of the locking mechanism 32 within the inner tube 16 by showing a cut-away with a side wall of the inner tube removed. The actuation bar 42 extends from the proximal end of the inner tube where a user interacts with the unlocking handle to cause the actuation bar to extend and retract relative to the inner tube. Towards the distal end of the inner tube, the actuation bar passes through an actuation bar support 46 situated in a wall (herein called the support wall 54) which is generally oriented perpendicular to the longitudinal axis of the inner tube 16. In some embodiments, the support wall 54 may be formed during manufacturing from the material formally resided prior to the aperture 34. The rod also passes through the central axis of a helical spring 52, a hole in the face of a single or plurality of locking plates 36, and terminates at a lock release bar 48. In the preferred embodiment there are two locking plates in succession. The spring 52 is preferably under compression between the support wall 54 and the face of the locking plate(s) 36. The locking plate or plates 36 are oriented as a lever arm with a pivot point or fulcrum 50 located on the inner wall off the inner tube 16 opposite the aperture 34. In some embodiments, the fulcrum 50 may be formed during manufacturing by a section of the inner tube by a stamping process.

Figure 8A:
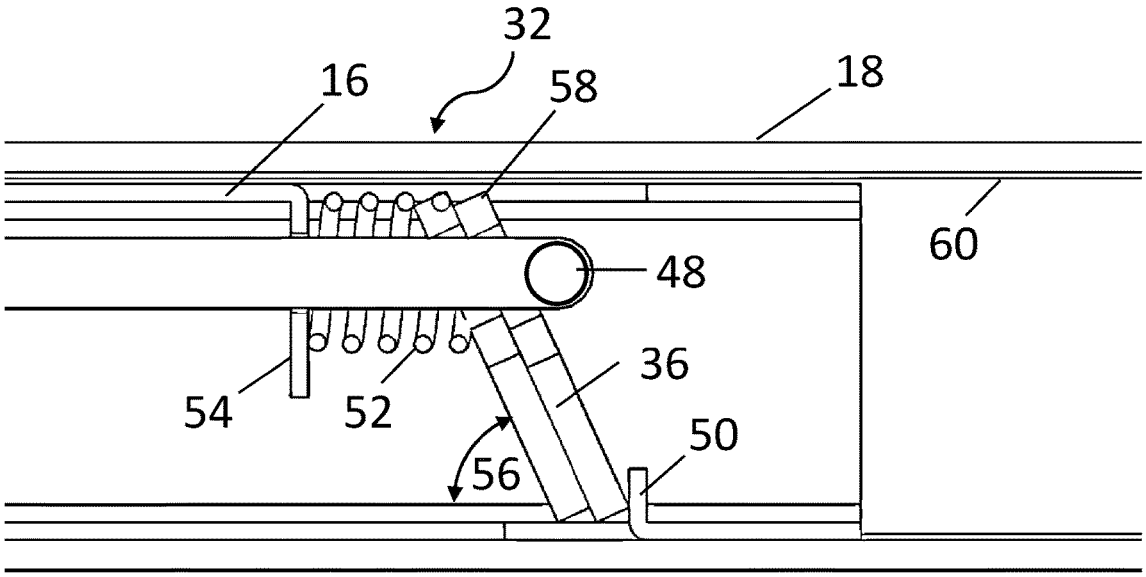
FIGS. 8A and 8B show additional cut-away views of a clutch locking mechanism for a clamping device.
Figure 8B:
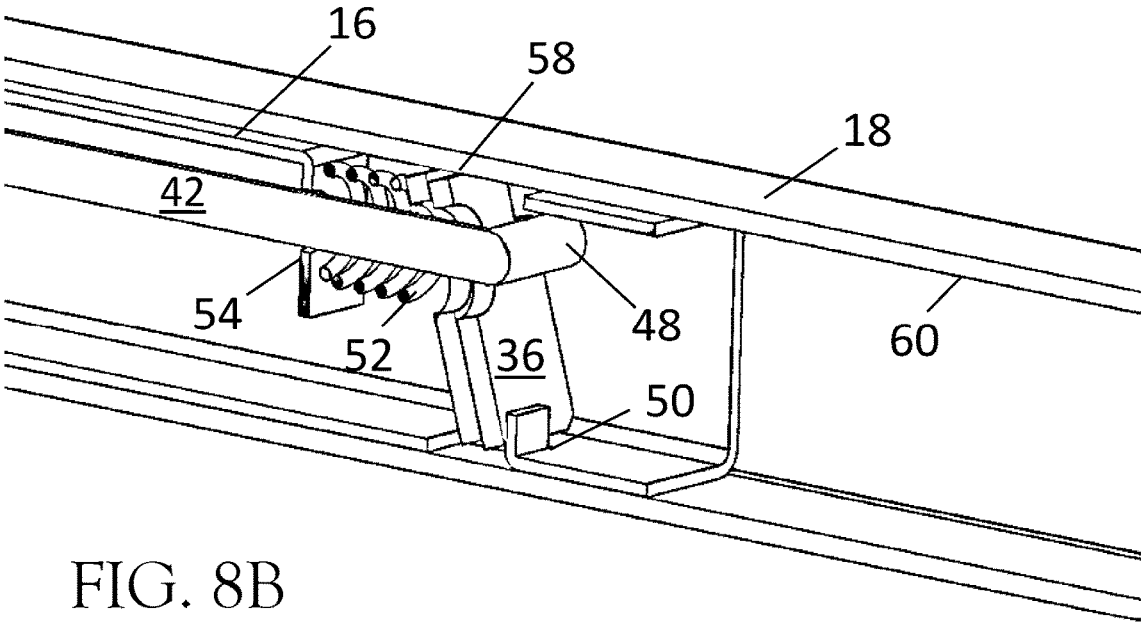

FIGS. 8A. and 8B are cut-away views of the locking mechanism 32 which further illustrate how the locking plates interact with the outer tube 18 to freely enable the outer tube to traverse the inner tube 16 one direction (proximal) and restrict movement in the opposite (distal) direction. In FIG. 8 the locking plates are tilted at an acute angle, herein the lock angle 56, relative to the horizontal inner surface of the inner tube 16. As the fulcrum 50 is fixed and the spring 52 applies force to proximal face of the locking plates, the lock angle 56 is determined either by the locking plates interacting with the interior of the outer tube 18 or the position of the lock release bar 48.

In the case where the lock release bar 48 is extended distally (i.e., locking position) the leading or upper edge of the locking plates, herein referred to as the blade, are being pushed by the spring towards and into the interior surface of the outer tube 60. When the user attempts to clamp a workpiece bringing together the fixed and adjustable jaws, the outer tube 14 engulfs the inner tube 16, thereby constricting the clamp. During the constricting of the clamp, the spring is further compressed, and the blades are able to glide on the interior surface of the outer tube 18. Any attempt to expand the clamp with the lock release bar in the locking position, however, causes the blade 58 to be wedged into the interior surface of the outer tube 60; Any additional force to expand only increases the upward force of the blade into the interior surface of the outer tube 60. In the preferred embodiment, the locking plates in their entirety or at minimum the blade will be constructed of materials having higher hardness (i.e., an increased hardness number characterization utilizing a method such as Vickers hardness test) than the inner tube 16.

To disengage the lock release bar 48 for the purposes of expanding or releasing the clamp, the actuation bar and consequently the lock release bar traverses towards the fixed jaw (i.e., traverses in a proximal direction). As presented in the preferred embodiment, the action to cause the actuation bar to travel towards the fixed jaw is accomplished using the unlocking handle. When the lock release bar moves proximally towards the fixed jaw it pulls the locking plates 36 towards the spring 52 while maintaining the pivot point at the fulcrum 50, thereby reducing the lock angle 56 retracting the blades 58 from contacting the interior surface of the outer tube 60. In this condition, the outer tube 18 is released to traverse the inner tube 16 in any direction along the axis of the inner tube.

Figure 9:
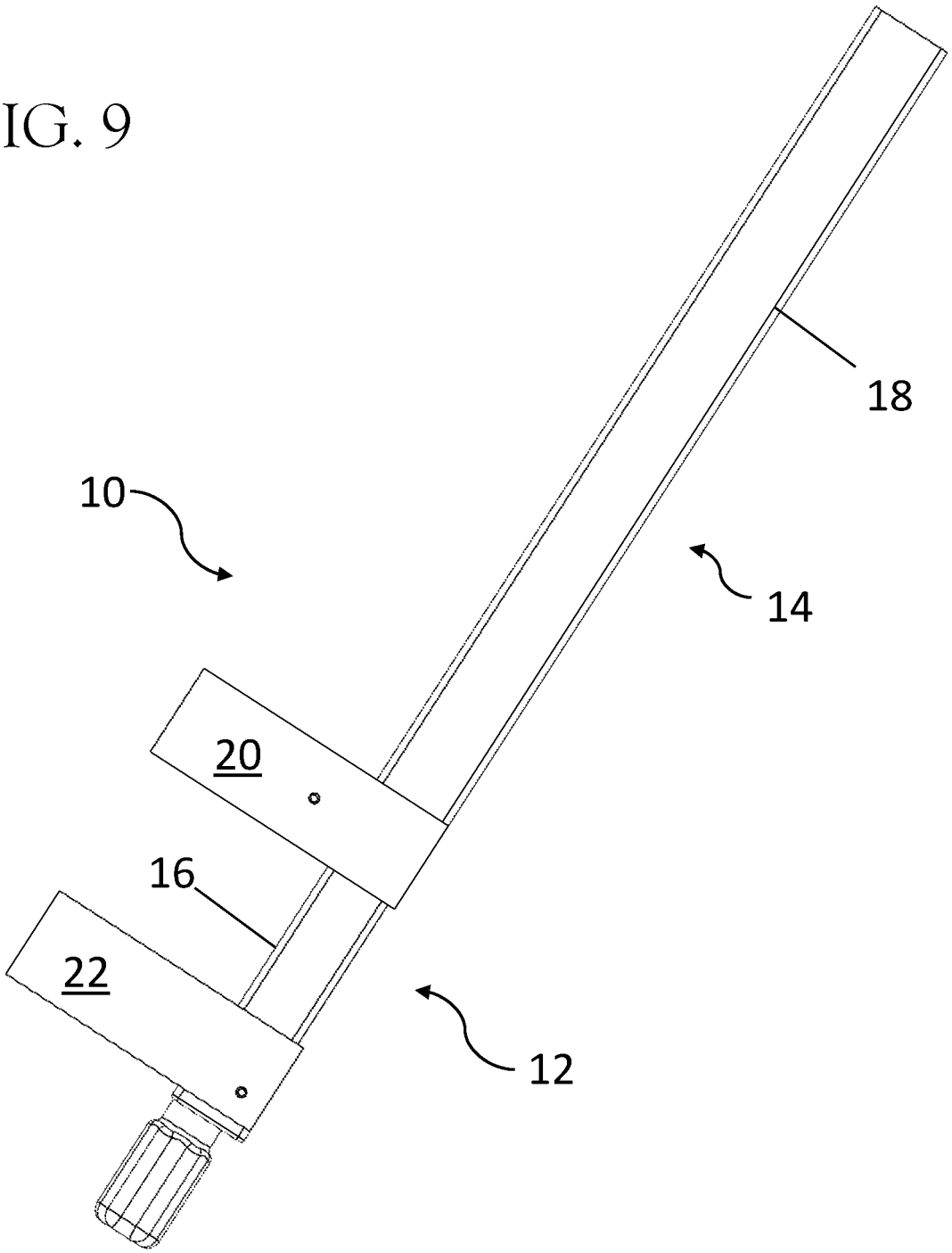
FIG. 9 shows a parallel jaw type clamping device with a nested bar assembly.

FIG. 9 shows the inventive concepts presented herein applied a parallel jaw clamp. Where appropriate, the reference numbering has been repeated to present similar concepts. The clamp 10 is again comprised of an inner assembly 12 and outer assembly 14. The inner assembly has a fixed jaw 22 located and affixed to a proximal end of a length of a generally square or rectangular tube, herein the inner tube 16. The outer assembly has an adjustable jaw 20 affixed to an end of a second length of square or rectangular tube, herein the outer tube 18. The lateral cross-sectional dimensions of the inner tube 16 are such that the inner tube may be nested into and traverse through the outer tube 18 as shown. In this figure the inner and outer assemblies are nested such that the adjustable jaw 20 on the outer assembly 14 is oriented such that it is adjacent to the fixed jaw 22 on the inner assembly 16.

Figure 10A:
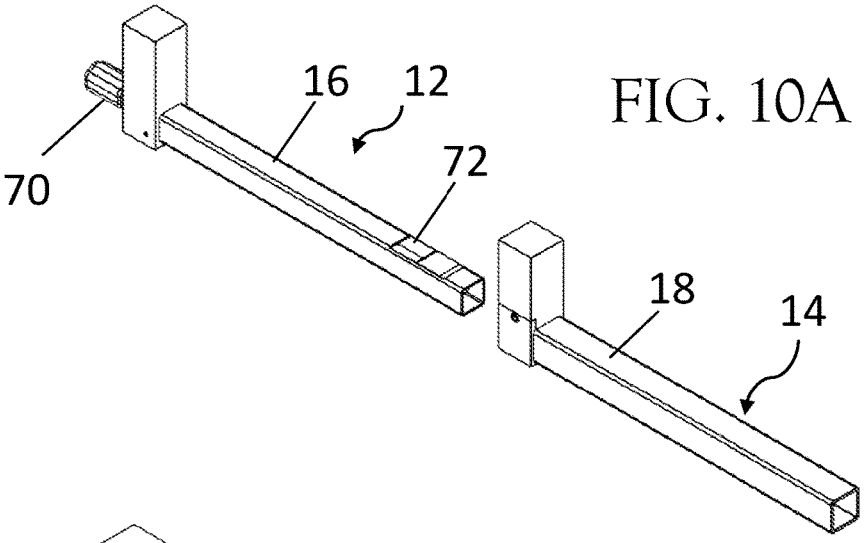
FIGS. 10A, 10B, 10C, and 10D illustrate multiple configurations of the parallel jaw type clamping device with a nested bar assembly.

FIG. 10A shows the parallel jaw style clamp 10 divided into its separate assemblies, specifically the inner assembly 12 and outer assembly 14. A notable difference from the F-Style clamp presented herein is the locking mechanism for securing the inner tube 16 to the outer tube 18. Where the locking mechanism presented in the F-Style clamp used the unlocking handle for releasing the outer assembly and used pressure from the screw clamp for precise tightening of the clamping system, the mechanics of the parallel jaw style clamp 10 lacks the screw clamp and alternatively uses a sliding lock system 72 to both secure and pull tougher the inner tube 16 and outer tube 18. As such, a tightening handle 70 adjacent to the fixed jaw 22 is utilized by the user for securing and pulling together the assemblies. The tightening handle 70 is affixed to an actuation bar that extends internally along the length of the inner tube 16 and engages the sliding lock system 72.

Figure 10B:
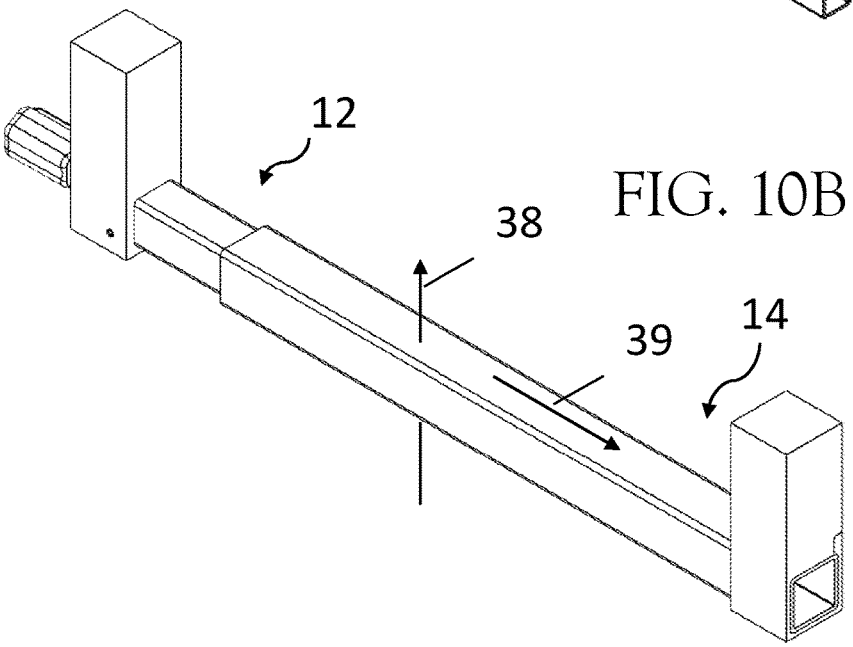
Figure 10C:
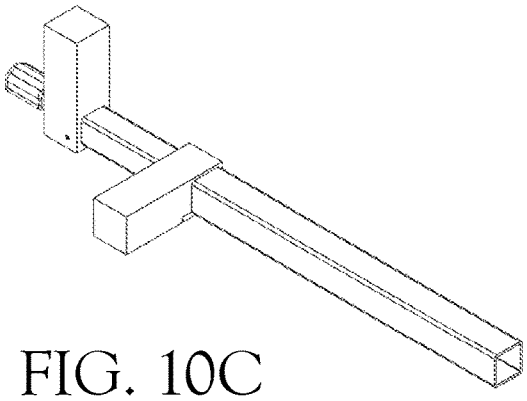
Figure 10D:
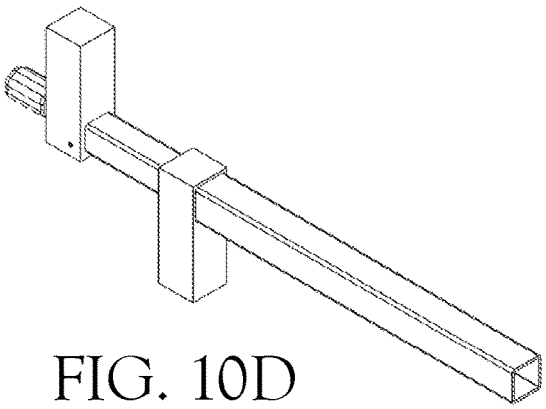

Various configurations of the parallel clamp are shown as FIGS. 10B, 10C, and 10D utilizing the nesting and reversable features of the inventive concept. For reference, the outer tube of the outer assembly has a longitudinal axis extending the length of the tube and is hereby defined as the horizontal axis 39. The horizontal axis is shown pointing towards the distal end of the clamp and the vertical axis 38 is shown pointing upwards. These axis and orientations are maintained throughout the specification. FIG. 10B illustrates a configuration where the outer assembly 14 is rotated 180 degrees around a vertical axis such that the adjustable jaw is positioned at the distal end of the clamp. FIGS. 10C and 10D illustrate configurations where the outer assembly is rotated 90 degrees and 180 degrees around the horizontal axis of the outer tube 18. It is understood that FIG. 10C may be rotated 90 degrees clockwise or counter clockwise creating a configuration that may be expressed as the outer assembly being rotated 90 or 270 degrees relative to the axis of the outer tube of the outer assembly. Also as was shown in the F-Style clamp, in some embodiments the profile of the adjustable jaw 20 of the parallel clamp which engages the workpiece and the corresponding and opposing profile of the adjustable jaw are mirror images of another.

Figure 11:
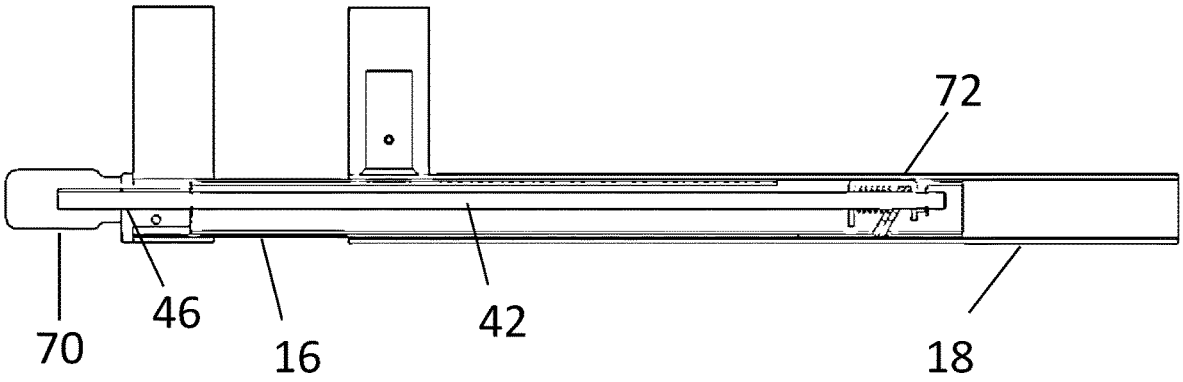
FIG. 11 shows a lower isometric view of an inner bar assembly of a parallel jaw type clamping device having a clutch mechanism

FIG. 11 is a cut-away view of the clamp allowing visibility of the controls for the sliding lock system 72. At the proximal end of clamp, the controls begin with the tightening handle 70 which is connected to the actuation bar 42. The actuation bar 42 passes through the actuation bar support 46 located near the fixed jaw and continues to along the inner tube 16 to the sliding lock system 72. For controlling the sliding lock system, the actuation bar does not move along the horizontal axis, that is to say the actuation bar does not extend or withdraw in relation to the inner tube 16.

Figure 12A:
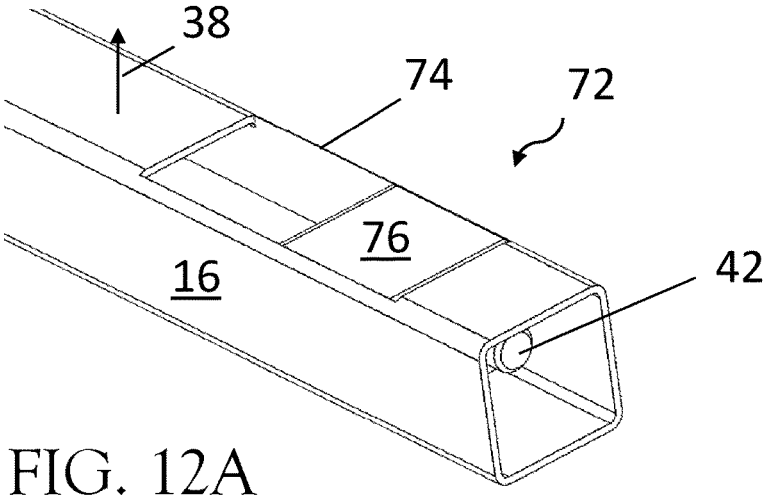
FIGS. 12A and 12B are upper and lower views of the clutch mechanism of the inner bar assembly of a parallel jaw type clamping device.
Figure 12B:
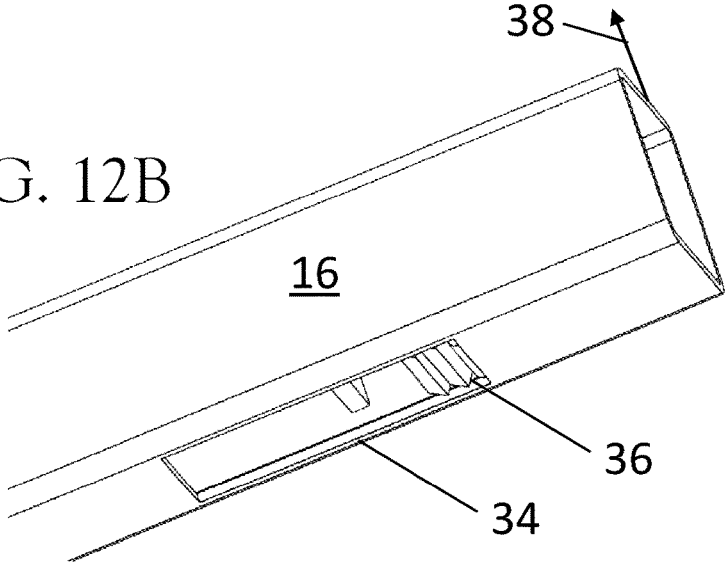

FIGS. 12A and 12B are respectively a downward view of the distal end of the inner tube 16 and upward view of the distal end of the inner tube. Reference to the vertical axis 38 are provided in both figures. In FIG. 12A, the sliding lock 72 is shown having a lock block 76 that traverses across an upper channel 74. The upper channel 74 is essentially a cut-out section of the inner tube. Also shown in FIG. 12A is the distal end of the actuation bar 42. FIG. 12B shows is an aperture 34 on the bottom side of the inner tube through which the locking plate or plates 36 pass to engage the outer tube.

FIGS. 13A, 13B, and 13C provide cut-away views of the sliding lock 72 system from different viewing angles. FIG. 13A provides a side cut-away view of the inner tube 16 and outer tube 18. The sliding lock system 72 includes a lock block 76 which integrates a support wall 54 perpendicular to the horizontal axis, a cross member which traverses along the upper channel 74, and a threaded section 80. The distal end of the actuation bar 42 is shown passing through a hole in the support wall 54 of the lock block 76, continuing through the axis of a compression spring 52, passing through a hole in the locking plate or plates 36, engaging in a threaded section of the lock block 80, and finally secured with a clip 78 used to limit the travel. The threaded section of the lock block 80 engages with a threaded section of the actuation bar 42 such that rotation of the actuation bar 42 causing the lock block to traverse along the horizontal axis. At least one locking plate 36 is required for operation, but there may be a plurality of locking plates working together.

FIG. 13A shows the locking plates 36 in the released position—a position which allows the outer tube 18 to freely move along the horizontal axis of the inner tube 16. In the released position, the lock block has traversed to a distal point where the locking plates 36 are pushed inwards by the release lip 82 of the inner tube 16, thereby disengaging the blade 58 from the interior surface of the outer tube 60.

By turning the tightening handle, the lock block will traverse in a proximal direction from the released position to an engagement position. The engagement position is defined by the blades 58 of the locking plates 36 protruding beyond the inner tube 16 and being in communication with the interior surface of the out tube 60. The engagement position is caused by the locking plates 36 being under no influence or reduced influence of the release lip and under pressure from the spring to transition to a more vertical orientation. In the engagement position, the outer tube 18 may freely move in a proximal direction guided by the inner tube 16 as the blade 58 glide across the interior surface of the outer tube 60, but attempts by the outer tube 18 to move in a distal direction cause the blades 58 to create a friction lock with the interior surface of the outer tube.

In the engagement position when the locking plates 36 are in communication and pressing into the interior surface of the outer tube, there are opposing forces pressing the upper surface 88 of the lock block into the opposing interior surface of the outer tube. To aid in creating a static friction lock between the sliding block and outer tube, the upper surface 88 of lock block 76 may have a friction increasing texture 86. The friction increasing texture may be part of the manufacturing process of the lock block (e.g., appearing in the die, a naturally occurring property of the chosen material, a series of grooves, an etching or chemical treatment, etc.) or may be a secondary component applied to the lock block (e.g., sandpaper with an adhesive backing).

By continuing to turn the tightening handle, the lock block 76 will continue to traverse in a proximal direction from the engagement position to a fully secured position. As the lock block traverses, the blades 58 of the locking plates 36 will further engage the interior surface of the outer tube 60 to a point that the locking blades are unable to press further into the inner tube 18 material. At this point, any further turns of the tightening handle will cause the lock block to further traverse proximally thereby causing the jaws of the clamp to constrict around the workpiece.

Additionally, features included in FIG. 13B include a frontal view of the clip 78 attached to the distal end of the actuation bar 42 which prevents the lock block 76 from moving beyond its travel limits. FIG. 13B also shows the lock plates 36 having a lock plate shoulder 84 which restricts the entirety of the lock plates to pass through the aperture 34.

FIG. 13C shows the upper channel 74 which assists in guiding the lock block along and the aperture 34 which the blade 58 of lock plates 36 pass through.

It is desirable to provide space between inner and outer assembly tubes (or other sliding clamp assemblies). Should glue or another substance be deposited on the surface of the inner assembly tube (or inner portion of a sliding assembly) this space will prevent or limit interference, contact or adherence of the glue or substance to the outer assembly tube (or outer portion of a sliding assembly). It is also desirable to provide a close running fit between sliding clamp assemblies.

Figure 14A:
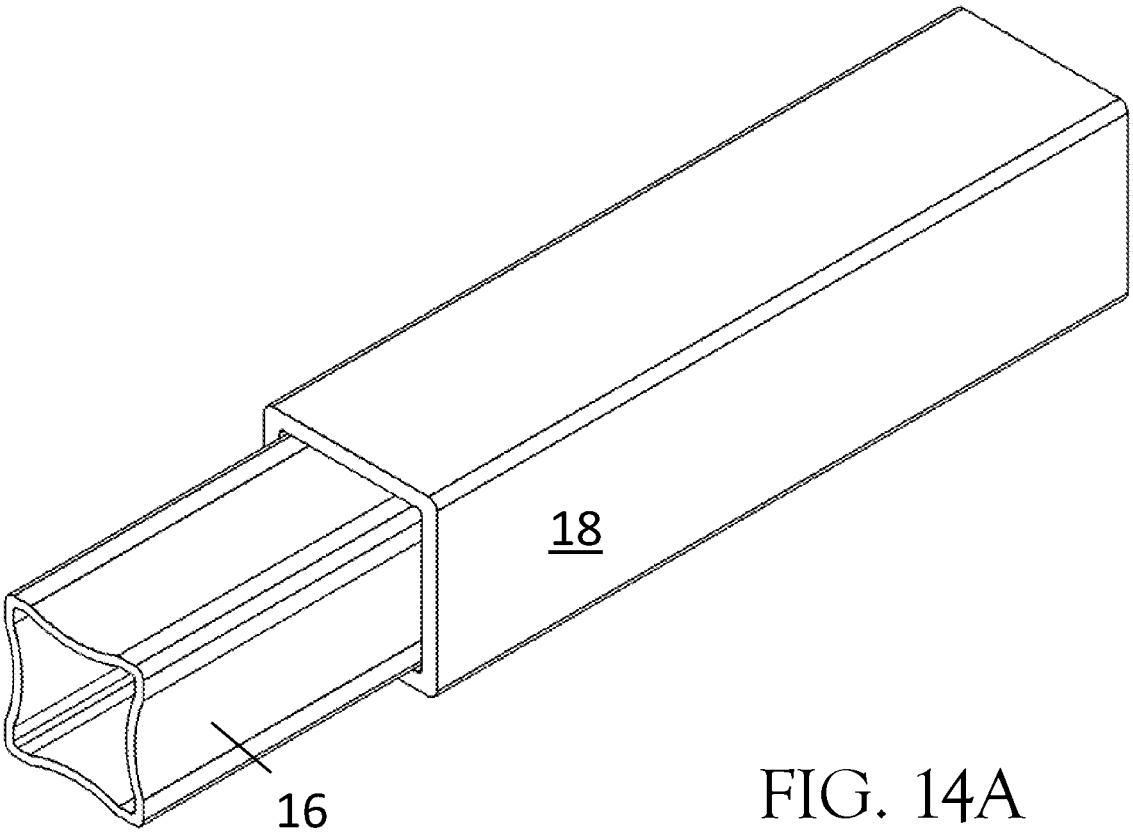
FIGS. 14A and 14B show an alternative inner bar structure for use with a nested clamping device.
Figure 14B:
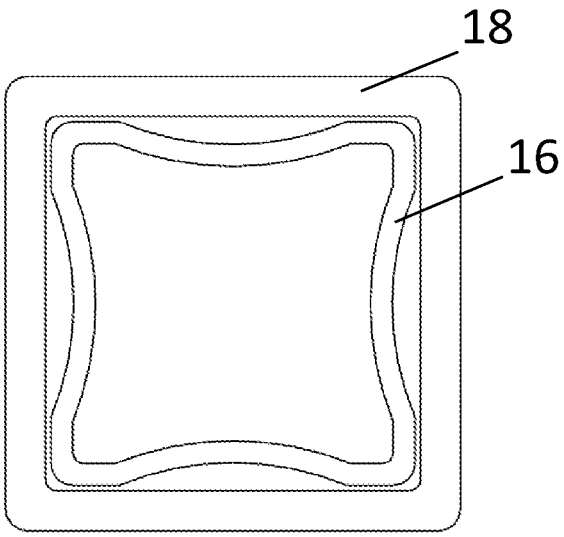

FIGS. 14A and 14B show an alternative design for the inner tube which is compatible with any of the inventive concepts presented herein. As shown, the outer tube 18 is represented as square or rectangular tube, while the inner tube 16 is constructed of four walls having a generally inwardly concave shape. Stated differently, this shape for the inner tube 16 is generally square or rectangular in cross section, has pronounced corners that produce a close fit with a mating part (i.e., outer tube), and have one or more a depressed sides providing clearance with a part.

In use the depressed area defined by the depressed sides provides space for glue or another substance to adhere to the inner assembly tube while limiting the preventing contact or adherence with the outer assembly tube.

Further extensions of the inventive concepts presented here may include embodiments having variations of the jaw such as removable jaws, adjustable jaws, interchangeable jaws, additional jaws per assembly, movable jaws and the ability to rotate jaws about the central axis relative to one and other. Similarly, the associated method may also include one or more of the following steps: adjustment of jaws, installation of jaws and rotation of jaws relative to one and other about the central axis.

The jaws of the clamp include a contact point intended to clamp, grasp, or hold items (such as workpieces) together, but may also be used to secure items to a fixture such as a work bench or structure. For the purpose of specification, the term workpiece includes construction materials, fixtures, structures, etc. The clamp may also be used to temporarily or permanently (i.e., where the clamp is left in place for prolonged duration as a method of construction).

What is claimed is:

1. A clamping device for restraining a workpiece comprising:

an inner tube and outer tube having telescopic characteristics, a shared medial axis, and each having a generally square cross section enabling the inner tube to be received by the outer tube at discrete rotations of 0, 90, 180, and 270 degrees relative to the medial axis, and ends of the outer tube being configured to receive distal end of the inner tube;

a pair of opposing jaws perpendicular to the medial axis including a first jaw secured at proximal end of the inner tube and a second jaw secured at distal end of the outer tube; and a locking device located at the distal end of the inner tube which includes a locking plate having a leading edge which extends-from and retracts-into an interior of the inner tube through an aperture under the influence of a locking control system.

2. The clamping device of claim 1 wherein, the locking control system comprises an actuation bar originating from a handle positioned near the proximal end of the inner tube, extending along a path generally parallel to the medial axis within the inner tube, and terminates at an actuator, said actuator in communication with the locking plate and directing an orientation of said locking plates and a degree to which the leading edge of the locking plates extend through said aperture.

3. The clamping device of claim 2 wherein, the locking device further comprises a sliding lock block which houses and provides a pivot point for the locking plate, is configured to travel a path defined by a channel opposite the aperture and parallel to the medial axis, and includes a threaded section which interfaces with the locking control system.

4. The clamping device of claim 1 wherein, the locking device further comprises a sliding lock block which is configured to travel a path parallel to the medial axis, and the locking control system comprises an actuation bar originating from a handle positioned at the proximal end of the inner tube, extending along a path generally parallel to the medial axis within the inner tube, and having a threaded section in communication with a threaded section of the sliding lock block, wherein a rotation of the actuation bar causes the sliding lock block to travel along the medial axis.

5. The clamping device of claim 4 wherein, travel of the sliding lock block towards proximal end of the inner tube causes the leading edge of the locking plate to engage an interior surface of the outer tube to create a frictional lock.

6. The clamping device of claim 5 wherein, travel of the sliding lock block towards the proximal end of the inner tube after establishment of the frictional lock causes the outer tube to travel proximally along the medial axis.

7. The clamping device of claim 3 wherein, the sliding lock block further includes a friction increasing texture disposed on the upper surface of the sliding lock block.

* * * * *